US006024545A

United States Patent [19]

Morioka

[11] Patent Number: 6,024,545

[45] Date of Patent: Feb. 15, 2000

[54] TUBE-PUMP

[75] Inventor: Shigeo Morioka, Katano, Japan

[73] Assignee: Aqua Tech Co., Ltd., Osaka, Japan

[21] Appl. No.: 08/882,942

[22] Filed: Jun. 26, 1997

[30] Foreign Application Priority Data

Jun. 28, 1996 [JP] Japan ..... 8-204095

[51] Int. Cl.[7] ..... F04B 43/08; F04B 43/00

[52] U.S. Cl. ..... 417/476; 417/478; 417/479

[58] Field of Search ..... 417/476, 478, 417/479

[56] References Cited

U.S. PATENT DOCUMENTS

| | | | |
|---|---|---|---|
| 2,414,355 | 1/1947 | Bogoslowsky | 418/45 |
| 3,687,580 | 8/1972 | Griffiths | 418/45 |
| 4,645,434 | 2/1987 | Bogen | 417/476 |
| 4,906,168 | 3/1990 | Thompson | 417/477 |
| 4,976,593 | 12/1990 | Miyamoto | 417/476 |
| 5,215,450 | 6/1993 | Tamari | 417/474 |

*Primary Examiner*—Charles G. Freay
*Assistant Examiner*—Paul Ratcliffe
*Attorney, Agent, or Firm*—Koda & Androlia

[57] ABSTRACT

A tube-pump of the invention comprising; an elastic-tube disposed in a ring-shaped form along the inner surface of a cylindrical chamber, a ring-shaped pressure member driven by an eccentric cam device disposed within said ring-shaped elastic tube which is pressed by the circular motion of said ring-shaped pressure member, and plural supporting means allowing a pressing motion to said elastic tube and preventing continuous rotating motions of said pressing member in a same direction holding said pressure member in said cylindrical chamber by said plural supporting means. By employing this pump construction, elongation of elastic tube and changes of its inner diameter possible by continuous rotations of ring-shaped pressure members into the same direction can be prevented, and at the same time, the pump output capacity can be kept at constant without damaging said elastic tube, remarkably improving the pump durability.

3 Claims, 1 Drawing Sheet

TUBE-PUMP

BACKGROUND OF THE INVENTION

1. Field of the Invention

This invention relates to a tube-pump feeding fluid enclosed in a ring-shaped elastic tube disposed along the inner wall of a cylindrical chamber by a rotating press means disposed within said elastic tube.

2. Description of the Prior Arts

Two types of the tube-pump one of which presses an elastic tube directly by means of a rotating press means such as a rotating roller, and another where said rotating press means consists of a ring-shaped pressure member disposed within an elastic tube and an eccentric cam device driving said ring-shaped pressure member, indirectly pressing said elastic tube by driving said pressure member in a circular motion along the inner wall of a cylindrical chamber have been known. For instance, Laid-Open Patent Hei 5-133350 shows a tube-pump of the latter type in FIG. 3 wherein an elastic tube is indirectly pressed. This tube-pump of indirect pressing type is advantageous over the direct pressing type in terms of the less damage and longer life of elastic tube.

However, when said ring-shaped pressure member is driven by rotating said eccentric cam device, said pressure member is rotated in a direction opposing to the rotation of said eccentric cam device applying a continuous pulling force to said elastic tube in a rotating direction of said pressure member. Although said pulling force is negligibly small in comparing to the force directly applied on said elastic tube by a roller, said elastic tube would be gradually elongated into the rotating direction of said pressure member when said pump is continuously operated. Thus, a number of troubles including a change of inner diameter of said elastic tube changing the output capacity of pump, a change of load of motor driving said eccentric cam device, a possible damage of elastic tube by the elongation of said tube, etc; are produced.

SUMMARY OF THE INVENTION

This invention is made to solve these problems. The first object of the invention is to stabilize the output capacity of tube-pump and the second object of the invention is to improve the life of tube-pump.

In order to accomplish these objects, the tube-pump of this invention is provided with an elastic tube disposed in a ring-shape along the inner surface of a cylindrical chamber, and a rotating press means consisting of a ring-shaped pressure member disposed within said ring-shaped elastic tube which is driven by an eccentric cam device to make a circular motion along the inner surface of said cylindrical chamber; wherein plural supporting means allowing a pressing action of said pressure member to said elastic tube, and preventing the continuous rotation of said pressure member in a same direction are provided holding said pressure member within said cylindrical chamber by said supporting means.

By taking the above-explained pump structure, the elongation and the change of inner diameter of elastic tube possible by a continuous rotation of said ring-shaped pressure member in a same direction can be prevented and the pump output capacity is stabilized. Since no elongation of said elastic tube and no damage on said elastic tube is possible, an extended pump-life can be obtained.

The above is a description of the fundamental pump structure, and its detailed pump structure is explained by referring FIGS. 1 and 2 showing an embodiment of the invention.

DETAILED DESCRIPTION OF THE PREFERRED EMBODIMENTS

Figure 1:
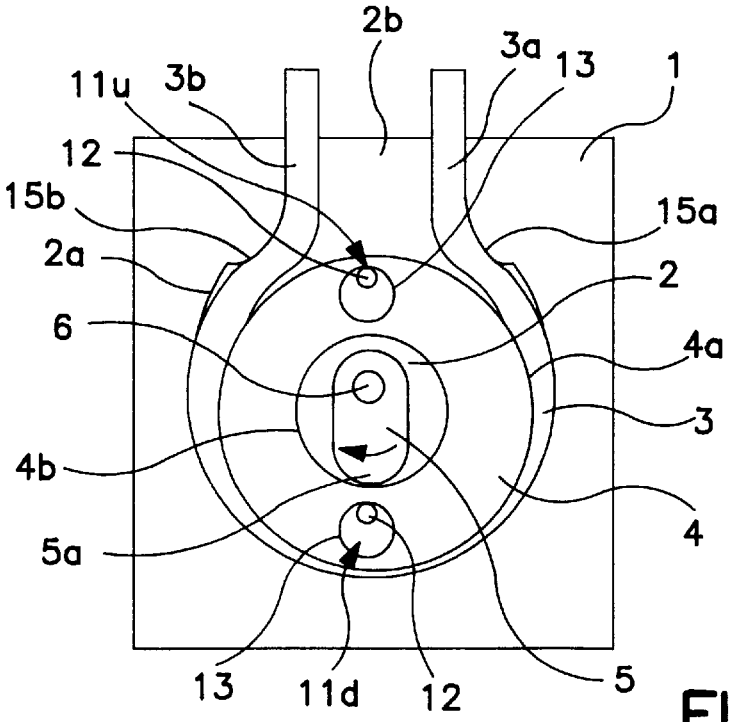
FIG. 1 shows a simplified front view of an embodiment of the invention.
Figure 2:
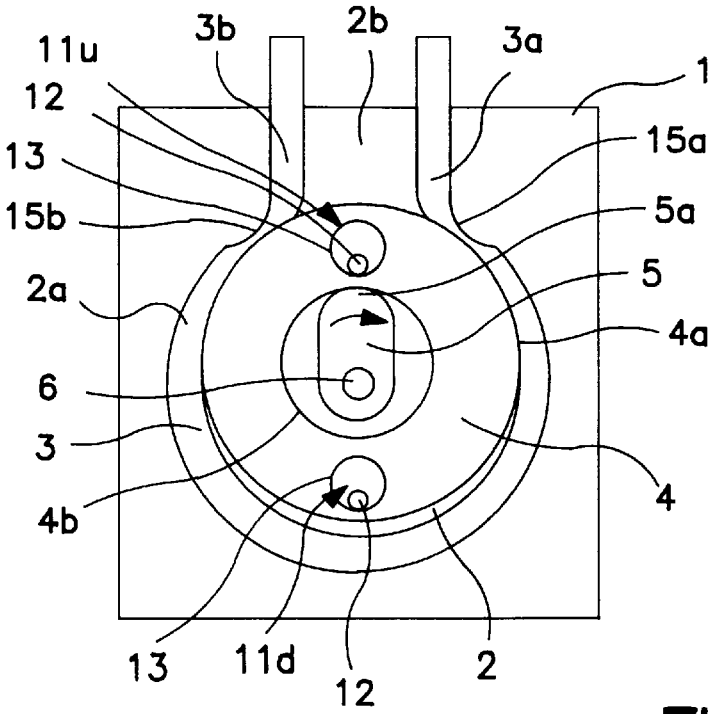
FIG. 2 shows a simplified front view of the same which is in a different state.

An embodiment of the invention is now explained in FIGS. 1 and 2 where 1 is a casing in which cylindrical chamber 2 is disposed. Cylindrical chamber 2 is provided with inner wall surface 2*a* in a range larger than the semi-circle and in a range smaller than the full-circle and opening 2*b* opened to the outside of casing 1 without forming inner wall surface 2*a*. 3 is a ring-shaped elastic tube disposed along inner wall surface 2*a*, and the both ends of said elastic tube are lead out of casing 1 through opening 2*b* forming inlet port 3*a* and outlet port 3*b*.

4 is a ring-shaped pressure member disposed within the inner side of elastic tube 3, 5 is an eccentric cam disposed at the inside of pressure member 4, and a rotating pressure means is consisted of pressure member 4 and eccentric cam 5. Eccentric cam 5 is fixed on rotating shaft 6 driven by a motor which is not shown here, and apex 5*a* of eccentric cam 5 is slid on inner surface 4*b* of pressure member 4 while it is rotating, pressing pressure member 4 against inner wall surface 2*a* of cylindrical chamber 2 making a circular motion of pressure member 4 along inner surface 2*a*.

Since the radius of outer circumference 4*a* of ring-shaped pressure member 4 is set at a dimension obtained by subtracting a dimension of more than twice of the thickness of elastic tube 4 from the radius of cylindrical chamber 2, and the sum of the distance from the center of rotating shaft 6 to apex 5*a* of eccentric cam 5 and the distance from the inner circumference 4*b* of pressure member 4 to outer circumference 4*a* is set at a dimension closing the internal fluid flow path by pressing elastic tube 3 when pressure member 4 is pressed by apex 5*a* of eccentric cam 5 toward inner wall surface 2*a*, a pumping action is performed by shifting the closed portion of elastic tube 4 according to the rotation of eccentric cam 5.

11*u* and 11*d* are an upper and a lower supporting means respectively supporting pressure member 4 within cylindrical chamber 2, and each consists of a combination of supporting shaft 12 fixed on casing 1 and hole 13 disposed in pressure member 4, and each of these is disposed at an upper and a lower positions along the vertical center line at a position shown in FIG. 1 where opening 2*b* is faced upward, that is, each of these is disposed at two positions symmetrically parted by 180 degrees regarding to the center of shaft of eccentric cam 5. The diameter of supporting shaft 12 is set at a dimension obtaining a necessary strength, and hole 13 is a circular hole having a diameter allowing pressure member 4 to have an enough freedom of its pressing action to elastic tube 3. On the other hand, in reverse to the drawing shown here, supporting shaft 12 may be disposed on pressure member 4 and hole 13 may be disposed on casing 1, and hole 13 may not necessarily be a circular hole, and could have any shape other than a circle so far as the motion freedom of pressure member 4 could be secured.

15*a* and 15*b* are inwardly facing convex parts disposed at a starting and an ending part of inner wall surface 2*a* respectively, and the protrusions of convex parts 15*a* and 15*b* are set at dimensions closing elastic tube 3 simultaneously by these two parts i. e., convex parts 15*a* and 15*b* when pressure member 4 is pressed by apex 5*a* of eccentric cam 5 to a upward position of opening 2*b*. As shown in above, since the flow of fluid can be stopped momentarily when elastic tube 3 is closed simultaneously at convex parts 15*a* and 15*b*, no check valve has to be installed in the fluid flow path, for an instance, at inlet port 3*a* or outlet port 3*b*.

Since this embodiment of the invention has a construction of above, when eccentric cam 5 is rotated in a clockwise direction shown by an arrow, the closed section of elastic tube 3 is shifted toward the clockwise direction also, the fluid held within a section of elastic tube 3 is discharged from outlet port 3*b* and the fluid is sucked through inlet port 3*a* performing a pump action. Moreover, when apex 5*a* of eccentric cam 5 is moved from the ending of inner wall surface 2*a* toward the starting part, elastic tube 3 is closed at two points, those are, convex parts 15*a* and 15*b*, so that no reverse flow of fluid is possible.

FIG. 1 shows a condition where apex 5*a* of eccentric cam 5 is facing to the right under. Before and after this, in a half-rotation state where apex 5*a* is facing to a state lower than the horizon, pressure member 4 moves to a lower state where supporting shaft 12 contacts with the upper part of hole 3 of upper supporting means 11*u*. Moreover, FIG. 2 shows a state where apex 5*a* is facing to the right above. Before and after this, in a half-rotation state where apex 5*a* is facing to a state higher than the horizon, pressure member 4 moves to an upper state where supporting shaft 12 contacts with a lower part of hole 13 of lower supporting means 11*d*. That is, pressure member 4 performs a swaying motion repeatedly making a circular motion in total making its contact point as a fulcrum, continuing the shifting of the fulcrum at every half-rotation.

Since the continuous rotation of pressure member 4 in a direction reverse to eccentric cam 5 is prevented by means of upper and lower supporting means 11*u* and 11*d*, there should be little chance of pulling elastic tube 3 continuously in a same direction. In addition to this, since the supporting points are distributed in a upward or a downward direction, and the swaying range of pressure member 4 centering around the same supporting point is narrowed, the magnitude of elongation would be smaller so that the change of restoring the original length of elastic tube would be higher holding the original internal diameter always stabilizing the amount of dis-charging fluid. Furthermore, since the load variation of motor and the chance of elastic tube damage would be smaller, the durability of pump would be remarkably improved.

Although the above-shown drawing shows an embodiment of the invention provided with two supporting means, when it is provided with more than two supporting means, for example, when it is provided with four supporting means adding one each supporting means to the left and right, the supporting points could be distributed further, so that the above-explained effects can be ensured further.

What is claimed:

1. A tube-pump comprising; a ring-shaped elastic tube disposed along an inner wall surface of a cylindrical chamber formed within a casing, a ring-shaped pressure member disposed within the inner side of said elastic tube, and an eccentric cam device provided within said ring-shaped pressure member for moving said pressure member as said eccentric cam device rotates to press said elastic tube between said pressure member and said inner wall surface of said cylindrical chamber, wherein plural supporting means allowing a pressing action of said pressure member onto said elastic tube while preventing continuous rotation of said pressure member and supporting said pressure member within said cylindrical chamber are provided, the inner wall surface of said cylindrical chamber consists of a range of surface larger than a half circumference of said cylindrical chamber but less than a full circumference of said cylindrical chamber, and the inner wall surface of the cylindrical chamber, the pressure member, the eccentric cam and the elastic tube are arranged and configured such that at one rotational position of said eccentric cam said pressure member is moved toward said inner surface of the cylindrical chamber to simultaneously close said elastic tube at both ends.

2. A tube-pump according to claim 1 wherein totally two of said supporting means are disposed at symmetrical positions mutually parting by 180 degrees regarding to the center of shaft of said eccentric cam device.

3. The tube-pump according to claim 1 wherein the inner wall surface of the cylindrical chamber is provided with convex parts projecting inwardly of the cylindrical chamber respectively at one end and at another end of said inner wall surface, and said elastic tube is simultaneously closed at said convex parts when said elastic tube is pressed by said pressure member.

* * * * *